United States Patent [19]

Kosaku

[11] 4,103,128

[45] Jul. 25, 1978

[54] TANK-TYPE COMPRESSED-GAS CIRCUIT-BREAKER HAVING CAPACITANCE-SUPPORTING MEANS

[75] Inventor: Itai Kosaku, Amagasaki, Japan

[73] Assignee: Mitsubishi Denki Kabushiki Kaisha, Tokyo, Japan

[21] Appl. No.: 578,796

[22] Filed: May 19, 1975

[30] Foreign Application Priority Data

Jun. 13, 1974 [JP] Japan ..... 49-67750

[51] Int. Cl.[2] ..... H01H 33/16

[52] U.S. Cl. ..... 200/144 AP; 200/148 B; 200/148 D; 200/145

[58] Field of Search ..... 200/144 AP, 148 B, 145, 200/148 D

[56] References Cited

U.S. PATENT DOCUMENTS

| | | | |
|---|---|---|---|
| 2,453,555 | 11/1948 | Thommen | 200/145 |
| 2,921,168 | 1/1960 | Furwald | 200/148 B |
| 3,160,727 | 12/1964 | Colclaser, Jr. et al. | 200/144 AP |
| 3,287,531 | 11/1966 | Yonezawa et al. | 200/144 AP |
| 3,383,519 | 5/1968 | Colclaser, Jr. et al. | 317/11 R |
| 3,435,166 | 3/1969 | Barkan | 200/148 B |
| 3,728,504 | 4/1973 | Beier | 200/144 AP |
| 3,745,281 | 7/1973 | Yoshioka | 200/148 R |
| 3,889,083 | 6/1975 | Guaglione et al. | 200/148 R |

*Primary Examiner*—Robert S. Macon
*Attorney, Agent, or Firm*—W. R. Crout

[57] ABSTRACT

A tank-type compressed-gas circuit-interrupter is provided utilizing line-to-ground capacitance means disposed within a grounded metallic tank structure controlling the rate of rise of the recovery voltage and serving an additional function of assisting to rigidly support the circuit-interrupting assembly within the grounded metallic tank.

6 Claims, 6 Drawing Figures

FIG. 1.
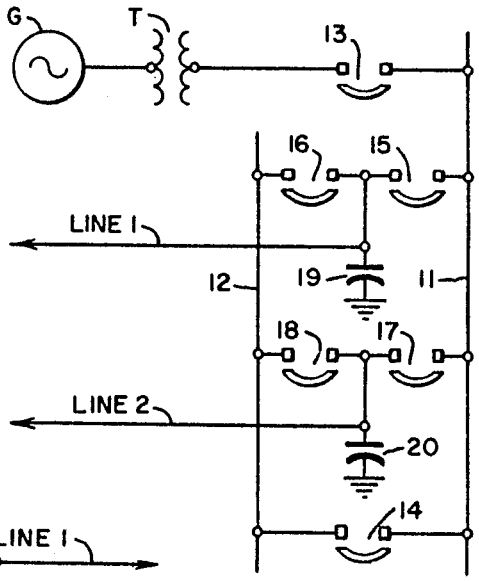
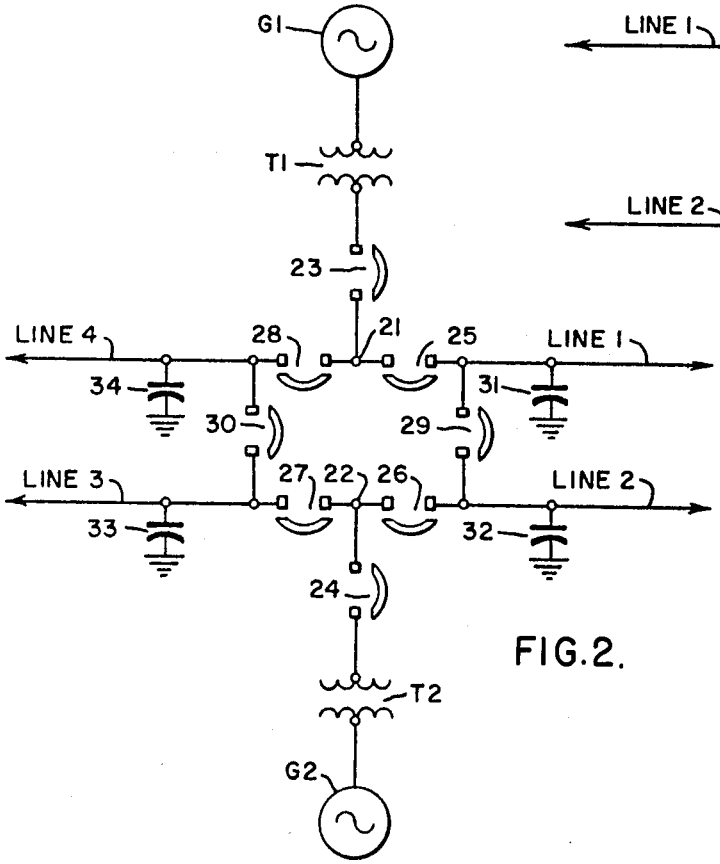
FIG. 2.
FIG. 3.
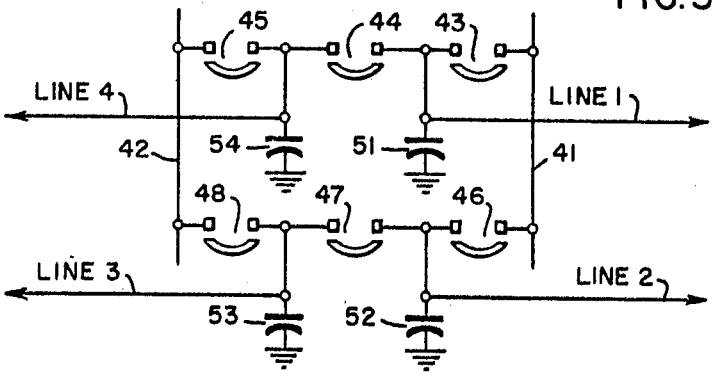

TANK-TYPE COMPRESSED-GAS CIRCUIT-BREAKER HAVING CAPACITANCE-SUPPORTING MEANS

CROSS-REFERENCES TO RELATED APPLICATIONS

Applicant is not aware of any related patent application pertinent to the present invention.

BACKGROUND OF THE INVENTION

The present invention is particularly concerned with tank-type compressed-gas circuit-interrupters of relatively high-power rating, in which it is desirable to utilize a line-to-ground capacitance means on the line side of the circuit-interrupter to control the rate of rise of the recovery voltage. Such a capacitance means is set forth and the theory thereof described in U.S. Pat. No. 3,383,519, issued May 14, 1968, to R. G. Colclaser, Jr., et al, entitled "Electric Power Distribution Systems", and assigned to the Westinghouse Electric Corporation.

SUMMARY OF THE INVENTION

In accordance with the principles of the present invention, a capacitance-supporting means for the terminal bushing is provided interiorly of the grounded metallic enclosing tank structure of a high-power, high-voltage compressed-gas circuit-interrupter. Preferably, the supporting capacitance means is disposed adjacent one end of the grounded tank to additionally serve a supporting function in desirably bracing the terminal bushing. Additionally, and as set forth in the aforesaid U.S. Pat. No. 3,383,519, the line-to-ground capacitance means moreover has a desirable additional function of increasing the interrupting capacity of the circuit-interrupter by lowering the rate of rise of the recovery voltage.

BRIEF DESCRIPTION OF THE DRAWINGS

FIGS. 1, 2 and 3 are single-line diagrams of power distribution systems embodying capacitance means of the prior art;

DESCRIPTION OF THE PREFERRED EMBODIMENTS

Figure 5:
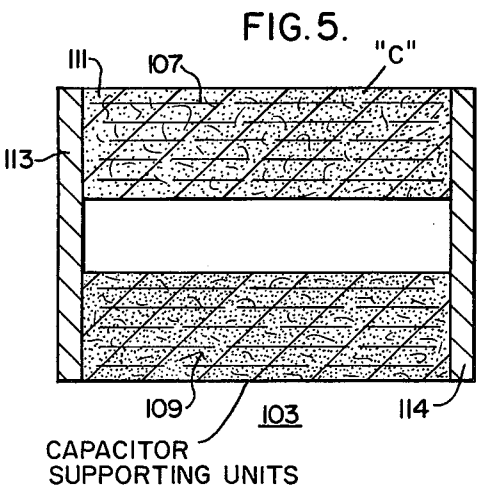
FIG. 5 illustrates an enlarged vertical sectional view taken through a capacitance-supporting block applicable to the present invention; and, FIG. 6 illustrates a modified-type of capacitance block support.

In the system shown in FIG. 1, a generator G is connected to a bus 11 through a transformer T and a circuit-breaker 13. The bus 11 is connected to a bus 12 through a bus-tie breaker 14. A transmission line 1 may be connected to the bus 11 through a breaker 15 or to the bus 12 through a breaker 16. Likewise, a line 2 may be connected to the bus 11 through a breaker 17 or to the bus 12 through a breaker 18. Capacitors 19 and 20 are connected to the lines 1 and 2, respectively. In a threephase system, a capacitor is connected between each phase conductor and ground. Thus, with the arrangement of six breakers shown in FIG. 1, six single-phase capacitor units are required to reduce the rate of rise of recovery voltage subsequent to the interruption of faults on the two transmission lines.

In the arrangement shown in FIG. 2, a generator G1 is connected to a bus 21 through a transformer T1 and a circuit-breaker 23. Likewise, a generator G2 is connected to a bus 22 through a transformer T2 and a breaker 24. A line 1 is connected to the bus 21 through a breaker 25, and a line 2 is connected to the bus 22 through a breaker 26. A line 3 is also connected to the bus 22 through a breaker 27, and a line 4 is connected to the bus 21 through a breaker 28. The line 1 may also be connected to the bus 22 through breakers 29 and 26, and the line 2 may be connected to the bus 21 through the breakers 29 and 25. Likewise, the line 3 may be connected to the bus 21 through breakers 30 and 28, and the line 4 may be connected to the bus 22 through the breakers 20 and 27. Capacitors 31 and 32 are connected between the phase conductors of lines 1 and 2, respectively, and ground. Likewise, capacitors 33 and 34 are connected between the phase conductors of lines 3 and 4, respectively, and ground. Thus, twelve single-phase capacitors are required for eight breakers and four transmission lines.

The arrangement shown in FIG. 3 is suitable for tieing systems together to permit an interchange of power between the systems. A transmission line 1 may be connected to a bus 41 through a breaker 43 and to a bus 42 through breakers 44 and 45. A line 2 may be connected to the bus 41 through a breaker 46 and to the bus 42 through breakers 47 and 48. A line 3 may be connected to the bus 42 through the breaker 48 and to the bus 41 through breakers 47 and 46. Likewise, a line 4 may be connected to the bus 42 through the breaker 45 and to the bus 41 through breakers 44 and 43. Thus, power may be interchanged between systems to which the transmission lines are connected. Capacitors 51 and 52 are connected between the phase conductors of lines 1 and 2, respectively, and ground. Likewise, capacitors 53 and 54 are connected between the phase conductors of lines 3 and 4, respectively, and ground. Thus, six capacitor units are required for each group of three breakers.

It will be noted that in each one of the distribution systems or bus arrangements the capacitors are connected only on the line side of the circuit breakers to which each transmission line is connected. They are disconnected from the bus side of the breaker by the open contacts of the breakers, and affect only the line-side component. The capacitors are connected directly between each phase conductor and ground. No circuit-breaker is interposed between the capacitor and the phase conductor. Each capacitor is utilized to reduce the effect of the travelling wave on a faulted line, thereby improving the interrupting performance of the circuit-breaker.

A further advantage of the capacitor is that it acts as a surge voltage absorber, thereby reducing the slope and magnitude of voltage surges associated with switching and lightning. A more economical breaker design can be made. The possibility of voltage breakdown is reduced and test programs need not be extensive on new designs.

By adding capacitors, it is possible to increase the interrupting ability of breakers of some types. Thus, a 10,000 mva. breaker could be rated at, for example, 12,500 mva. by merely applying the required capacitor values. This could result in reduced costs and faster service in rebuilding old breakers.

From the foregoing description, it is apparent that a capacitor can be used to modify special high recovery rate situations, providing assurance that a circuit breaker will interrupt satisfactorily. Although the primary purpose of the capacitor is to reduce the severity of the recovery voltages produced by line faults, it will also reduce the recovery-voltage frequencies produced by line-side reactors or transformers.

Figure 4:
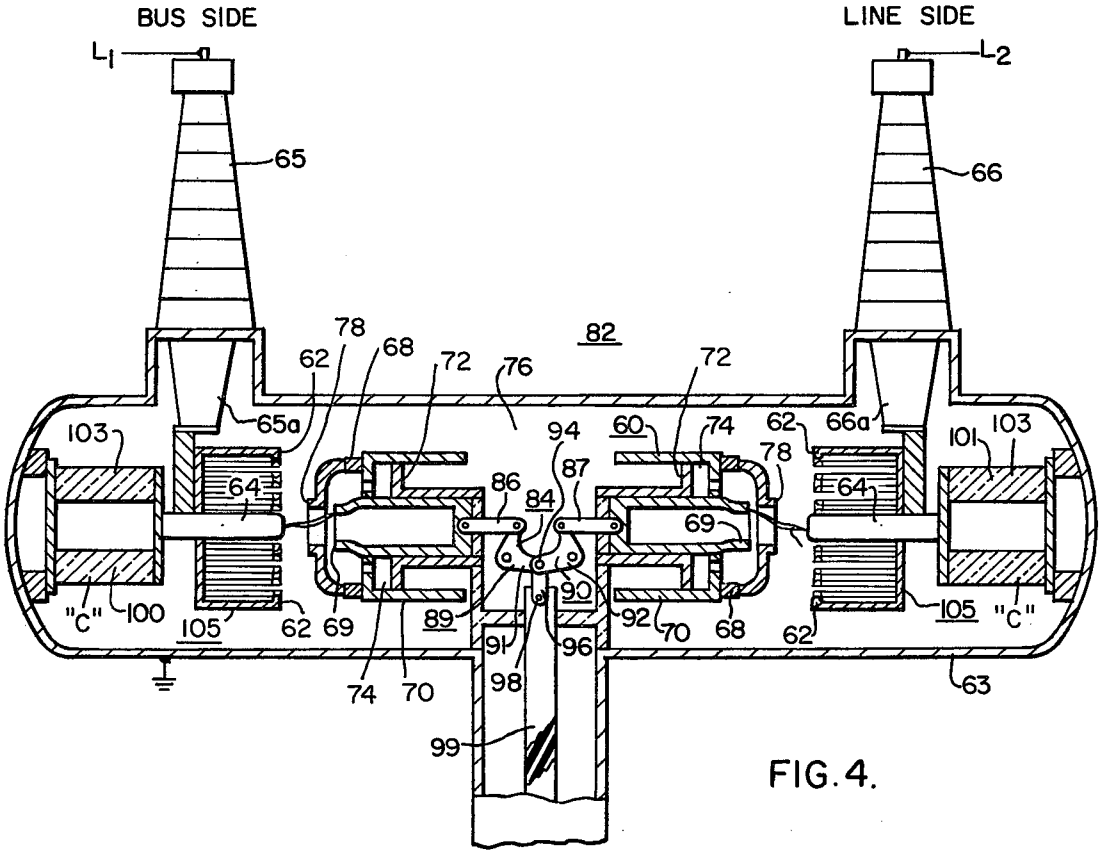
FIG. 4 is a vertical sectional view taken through a tank-type compressed-gas circuit-interrupter, embodying the principles of the present invention, the contact structure being illustrated in the open-circuit position.

An embodiment of a compressed-gas circuit-interrupter, utilizing the principles of the present invention, is set forth in FIG. 4. It will be observed that there is provided an arc-extinguishing assemblage 60 of the twobreak type involving a pair of stationary main contacts 62 and a pair of stationary arcing contacts 64 disposed at opposite ends of the tank structure 63. The arc-extinguishing structure 60 is supported at the lower ends of the terminal-bushings 65 and 66 leading to the connected circuit $L_1$, $L_2$.

Cooperable with the main stationary finger-type contacts 62 is a movable main contact 68, which is affixed to and movable with a movable operating cylinder 70 slidable upon a stationary fixed piston 72, and operable to compress gas within the piston-compression space or chamber 74. A movable arcing contact 69 makes contacting engagement with the stationary arcing contact 64 in the closed position (not shown).

The compression of gas 76 such as sulfur-hexafluoride gas ($SF_6$), for example, within said compression chamber 74 forces the gas 76 outwardly through an insulating orifice nozzle 78, and into engagement with the arc, the disposition of which is illustrated by the reference numeral 80, although FIG. 4 indicates the fully-open-circuit position of the circuit-interrupter 82.

The operation of the two movable main and arcing contacts 68 and 69 is effected by a crank arm structure 84 comprising a pair of floating links 86, 87, which are connected to two pivotally-mounted crank arms 89, 90, the lower crank portions 91, 92 of which are pivotally connected together at 94, and to a vertically-extending floating link 96, the latter being pivotally connected, as at 98, to the upper end of a linearly-movable operating rod 99.

During the closing operation, the operating rod 99 is moved upwardly by any suitable mechanism, thereby rotating the operating cranks 89, 92 in opposite directions to effect closing of the main contact structure 62, 68, and, additionally, closing of the arcing contact structure 64, 69.

Due to the hammering, and impact forces involved during the closing operations of the circuit-breaker 82, it is desirable to relieve the stress imposed upon the lower interior ends **65*a*, 66*a* of the terminal-bushings 65 and 66. To effect this purpose, it is desirable therefore to provide supporting members 100, 101. According to the principles of the present invention, the line side support member 101 incorporates a capacitance 103**, thus affording a desirable line-to-ground capacitance C having the desirable functions, as set forth in the aforesaid U.S. Pat. No. 3,385,519, the subject matter of which is incorporated herein by reference.

From the foregoing, it will be apparent that the capacitance block 101 not only provides a desirable supporting function for the stationary contact structure 105, which is desirable, particularly during the closing operations of the circuit-breaker 82, but, additionally, has the desirable function of providing a desired line-to-ground capacitance 103 for the circuit-interrupter 82. In addition, it will be observed that providing the capacitance supporting member 101 within the tank 63 saves space, and provides a desirable location for this combined supporting and capacitance member 101.

With reference to FIG. 5, it will be observed that the capacitance 103 may be provided by placing metallic foils 107 and the intervening insulating paper 109 on top of each other, and utilizing a suitable resinous material, such as epoxy resin 111, for example, to penetrate the insulating layers. The two ends of the metallic foils 107 are electrically connected to the end metallic fittings 113 and 114. Furthermore, it is possible to adjust the capacity of the capacitance 103 by changing the size of the metallic foils 107 being overlapped, and the number of capacitor elements being arranged in parallel. Thus, a plurality of capacitors are formed in series or parallel between both ends 113 and 114 of the metallic fittings, and moreover, the mechanical strength is made to be improved between said metallic fittings 113 and 114.

Figure 6:
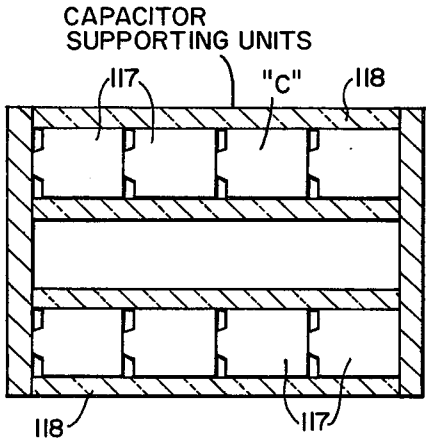

With reference to the alternate capacitor construction shown in FIG. 6, it will be observed that this construction provides series-arranged ceramic condenser elements 117 or oil condensers within the insulating supporting tubes 118 having the requisite mechanical strength.

In the case of a double-break circuit-breaker, the relatively-stationary contacts, disposed at opposite ends of the tank structure 63, may be made to be supported by the supporting structures 100, 101. In this way, by constructing the supporting capacitive elements as one of the supporting structures 101, the space for the capacitor, which previously, according to the prior art, had been required to be separately arranged, external of the tank, has become unnecessary, and the large capacitance may readily be accommodated by providing it interiorly of the tank structure within the support 101. The result is that the oscillating waveforms may be minimized or reduced in the case of faults occurring within short distances of the circuit-breaker and the rate of rise of the recovery-voltage transient may be diminished. Additionally, the tank 63 is not required to be enlarged, and the performance of the entire circuit-breaker 82 is improved, as a whole.

From the foregoing description it will be apparent that there has been provided an improved circuit-breaker construction in which the line-to-ground capacitance 101 provides an additional desirable supporting function, and is preferably located interiorly of the surrounding grounded tank structure 63.

Although there has been illustrated and described a specific structure, it is to be clearly understood that the same was merely for the purpose of illustration, and that changes and modifications may readily be made therein by those skilled in the art, without departing from the spirit and scope of the invention.

I claim:

1. A tank-type compressed-gas circuit-breaker including a grounded metallic tank structure, a terminal-bushing extending into said tank structure and supporting a relatively-stationary contact structure adjacent its interior end, a movable contact structure movable relative to said stationary contact structure and cooperable therewith to establish an arc, and capacitance-supporting means disposed within said tank structure and adjacent one interior end of the tank structure to assist the terminal-bushing in supporting the relatively-stationary contact structure against the impact forces involved during the closing operation of the circuit-breaker and also providing a desirable line-to-ground capacitance for the circuit-breaker itself.

2. The combination according to claim 1, wherein the movable contact is associated with an operating-cylinder piston arrangement which moves over a relatively stationary piston and forces compressed gas into the established arc.

3. The combination according to claim 2, wherein the operating cylinder includes said movable main contact, and said relatively stationary main contact is provided cooperable therewith.

4. The combination in a high-power compressed-gas circuit-interrupter of a longitudinally-extending metallic grounded tank structure, a pair of terminal-bushings extending downwardly interiorly within said tank structure and supporting a pair of relatively-stationary contacts adjacent the opposite interior ends of said tank structure, a pair of relatively-movable contacts movable inwardly away from said stationary contacts and operable to establish two serially-related arcs interiorly within the tank structure, means operatively moving the two movable contacts in their opening and closing movements toward each other, and a capacitance-supporting element disposed interiorly of the tank structure adjacent at least one end thereof on the line side to assist the terminal-bushing on the line side in supporting the relatively-stationary contact structure at said one line side against the impact forces involved during the closing operation of the circuit-interrupter and additionally providing a line-to-ground capacitance for the circuit-interrupter.

5. A tank-type compressed-gas circuit-breaker including a grounded metallic tank structure, at least one terminal-bushing extending into said tank structure and supporting a relatively-stationary contact structure adjacent its interior end, means defining a movable contact structure movable relative to said stationary contact structure and cooperable therewith to establish an arc, a capacitance pedestal disposed interiorly within said tank structure to assist the terminal-bushing in supporting the relatively-stationary contact structure against the impact forces involved during the closing operation of the circuit-breaker and also providing a desirable line-to-ground capacitance for the compressed-gas circuit-breaker itself.

6. A tank-type compressed-gas circuit-breaker including a grounded elongated metallic tank structure, a pair of laterally-spaced terminal-bushings extending downwardly into said elongated tank structure adjacent the opposite ends thereof and each supporting a relatively-stationary contact structure adjacent its interior end, a pair of relatively-movable contacts movable inwardly away from said relatively-stationary contacts in collapsing and expanding relationship and operable thereby to establish two electrically serially-related arcs interiorly within said elongated metallic tank structure, means operatively moving the two movable contacts in their opening and closing contracting and expansive movements, and a capacitance-pedestal supporting structure disposed interiorly of the elongated metallic tank structure adjacent both ends thereof to assist the terminal-bushings in supporting the relatively-stationary contact structures against the impact forces involved during the closing operation of the circuit-breaker and moreover providing a desired line-to-ground capacitance for the circuit-breaker.

* * * * *